US006726468B2

(12) United States Patent
Ibrahim et al.

(10) Patent No.: US 6,726,468 B2
(45) Date of Patent: Apr. 27, 2004

(54) PRE-HEATING DILUTION GAS BEFORE MIXING WITH STEAM IN DIFFUSION FURNACE

(75) Inventors: Kader Ibrahim, Kedah (MY); Umasangar V. Pillai, Kuala Lumpur (MY); Joon Ho Joung, Seoul (KR)

(73) Assignee: SilTerra Malaysia Sdn. Bhd., Kedah (MA)

( * ) Notice: Subject to any disclaimer, the term of this patent is extended or adjusted under 35 U.S.C. 154(b) by 0 days.

(21) Appl. No.: 10/255,200

(22) Filed: Sep. 25, 2002

(65) Prior Publication Data

US 2004/0058287 A1 Mar. 25, 2004

(51) Int. Cl.[7] ..... F23D 11/44
(52) U.S. Cl. ..... 431/11; 431/161; 431/354
(58) Field of Search ..... 431/11, 161, 354

(56) References Cited

U.S. PATENT DOCUMENTS 5,785,762 A 7/1998 Masuda
6,221,791 B1 * 4/2001 Wang et al. ..... 438/773
6,276,926 B1 * 8/2001 Chen et al. ..... 431/350
6,348,397 B2 2/2002 Ide
6,348,417 B1 2/2002 Moriyama
6,365,519 B2 4/2002 Kraus et al.
6,372,663 B1 * 4/2002 Yeh et al. ..... 438/773
6,391,116 B2 5/2002 Moriyama

* cited by examiner

*Primary Examiner*—Alfred Basichas
(74) *Attorney, Agent, or Firm*—Townsend and Townsend and Crew LLP

(57) ABSTRACT

Embodiments of the present invention are directed to apparatus and methods of supplying a diluted process gas into a diffusion furnace for forming an oxide layer on a substrate in the diffusion furnace. One or more inlet gases are supplied into a chamber, and are heated in the chamber to generate an oxidizing gas such as steam. A dilution gas is flowed through a dilution gas line which extends through the chamber to permit heating of the dilution gas by the heat in the chamber without mixing the dilution gas and the oxidizing gas in the chamber. The oxidizing gas and the heated dilution gas are mixed downstream of the chamber prior to entry into the diffusion furnace.

20 Claims, 2 Drawing Sheets

PRE-HEATING DILUTION GAS BEFORE MIXING WITH STEAM IN DIFFUSION FURNACE

BACKGROUND OF THE INVENTION

The present invention relates generally to semiconductor manufacturing and, more particularly, to a diffusion furnace used in a diffusion process for forming an oxide film on a semiconductor wafer by thermal oxidation.

Diffusion furnaces have been used to form oxide films on semiconductor substrates. Some diffusion furnaces are configured to mix a dilution gas in an oxidizing gas such as water vapor, and thermally oxidize the mixture to form an oxide film on the semiconductor wafer. Various examples of oxide forming apparatus that employ diffusion furnaces are illustrated in FIGS. 1–3.

As shown in FIG. 1, a diffusion furnace apparatus 10 includes a torch heater 12 for heating $H_2$ from line 14 and $O_2$ from line 16 to a temperature that is higher than the ignition point for $H_2$. Water vapor or steam is generated from the $H_2$ and $O_2$ in the external torch chamber 20. A dilution gas is added to the water vapor via a dilution gas line 24 prior to entry into the furnace tube 26 for thermal oxidation to form the oxide film on one or more semiconductor wafers inside the furnace tube 26. An exhaust 28 is provided for the gas to exit the furnace tube 26. Because the dilution gas is colder than the steam, the mixing of the colder dilution gas with the steam may cause condensation.

FIG. 2 shows a diffusion furnace apparatus 30 which heats the dilution gas prior to mixing with the steam. For convenience, the same components have the same reference characters in FIG. 2 as in FIG. 1. In FIG. 2, a heated dilution gas line 34 introduces a heated dilution gas into the steam line prior to entry into the furnace tube 26. This apparatus 30, however, requires an additional heater and quartz piece to provide the heated dilution gas.

In another diffusion furnace apparatus 40 shown in FIG. 3, the dilution gas 42 is introduced through the $H_2$ line 14 or the $O_2$ line 16. This approach is not desirable for forming thin oxides which require very low gas flow. The need to maintain a very low gas flow will cause the torch flame to be unstable and lead to flame out problems.

BRIEF SUMMARY OF THE INVENTION

The present invention is directed to providing a dilution gas in a diffusion furnace apparatus for forming an oxide layer on a semiconductor wafer. In some embodiments, the dilution gas is mixed with steam and the mixture is thermally oxidized to form the oxide film on the semiconductor wafer. The dilution gas is preheated prior to mixing with the steam to avoid condensation problems. The dilution gas is heated by an existing heater in the external torch chamber or combustion chamber used to produce the oxidizing gas such as steam, so that no additional heater is needed. The preheated dilution gas is mixed with the steam at the outlet of the external torch chamber or combustion chamber so as not to cause any disturbance to the stable flame in the chamber. The dilution gas flow desirably is sufficiently low so that it is possible to form a very thin oxide layer with uniform thickness.

An aspect of the present invention is directed to an apparatus for supplying a diluted process gas into a diffusion furnace for forming an oxide layer on a substrate in the diffusion furnace. The apparatus comprises a torch device configured to receive one or more inlet gases supplied by one or more inlet gas lines. The torch device includes a torch heater configured to generate an oxidizing gas by heating the inlet gases in a torch chamber disposed downstream of the torch heater. A dilution gas line is configured to receive a dilution gas. The dilution gas line extends through the torch chamber to permit heating of the dilution gas by the heat in the torch device without mixing the dilution gas and the oxidizing gas in the torch chamber. A mixing region downstream of the torch chamber is configured to receive and mix the oxidizing gas and the heated dilution gas prior to entry into the diffusion furnace.

In some embodiments, the oxidizing gas comprises steam generated from $O_2$ and $H_2$ in the torch chamber. The dilution gas is typically Ar or $N_2$. The torch heater is configured to produce a flame in the torch chamber to generate the oxidizing gas from the inlet gases. The dilution gas line is configured to produce a dilution gas flow of at most about 20 slm.

Another aspect of the invention is directed to an apparatus for supplying a diluted process gas into a diffusion furnace for forming an oxide layer on a substrate in the diffusion furnace. The apparatus comprises an oxidizing gas chamber configured to receive one or more inlet gases supplied by one or more inlet gas lines, and a mechanism for heating the one or more inlet gases in the oxidizing gas chamber to generate an oxidizing gas. A dilution gas line is configured to receive a dilution gas. The dilution gas line extends through the oxidizing gas chamber to permit heating of the dilution gas by the heat in the oxidizing gas chamber without mixing the dilution gas and the oxidizing gas in the oxidizing gas chamber. A mixing region downstream of the oxidizing gas chamber is configured to receive and mix the oxidizing gas and the heated dilution gas prior to entry into the diffusion furnace.

Another aspect of the present invention is directed to a method of supplying a diluted process gas into a diffusion furnace for forming an oxide layer on a substrate in the diffusion furnace. The method comprises supplying one or more inlet gases into a chamber, and heating the one or more inlet gases in the chamber to generate an oxidizing gas. A dilution gas is flowed through a dilution gas line which extends through the chamber to permit heating of the dilution gas by the heat in the chamber without mixing the dilution gas and the oxidizing gas in the chamber. The oxidizing gas and the heated dilution gas are mixed downstream of the chamber prior to entry into the diffusion furnace.

In some embodiments, heating the one or more inlet gases comprises producing a flame from the $O_2$ and $H_2$ to generate the steam. The dilution gas flow rate is sufficiently low so that the dilution gas is heated to a temperature which is substantially equal to a temperature of the oxidizing gas before mixing the oxidizing gas and the heated dilution gas.

Another aspect of the invention is directed to a method of supplying a diluted process gas into a diffusion furnace for forming an oxide layer on a substrate in the diffusion furnace. The method comprises supplying one or more inlet gases into a chamber, and producing a flame in the chamber to heat the one or more inlet gases in the chamber to generate an oxidizing gas. A dilution gas is flowed through a dilution gas line which extends at least partially through the chamber to a location downstream of the flame to permit heating of the dilution gas by the heat in the chamber without mixing the dilution gas and the oxidizing gas at or upstream of the flame. The oxidizing gas and the heated dilution gas are mixed downstream of the flame prior to entry into the diffusion furnace.

DETAILED DESCRIPTION OF THE INVENTION

Figure 1:
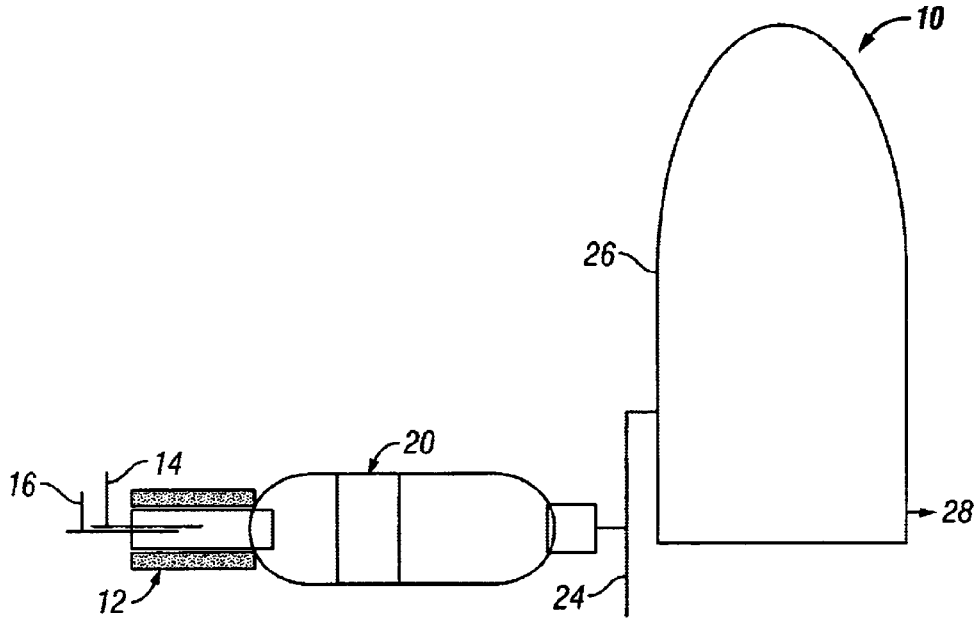
FIG. 1 (Prior Art)
FIG. 1 is a simplified schematic view of a prior diffusion furnace apparatus.
Figure 2:
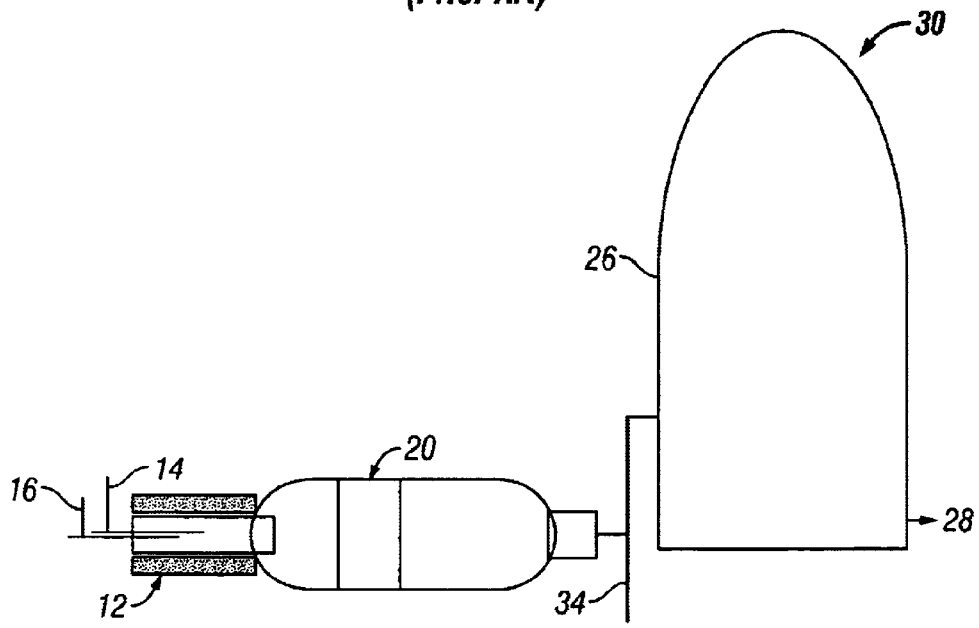
FIG. 2 (Prior Art)
FIG. 2 is a simplified schematic view of another prior diffusion furnace apparatus.
Figure 3:
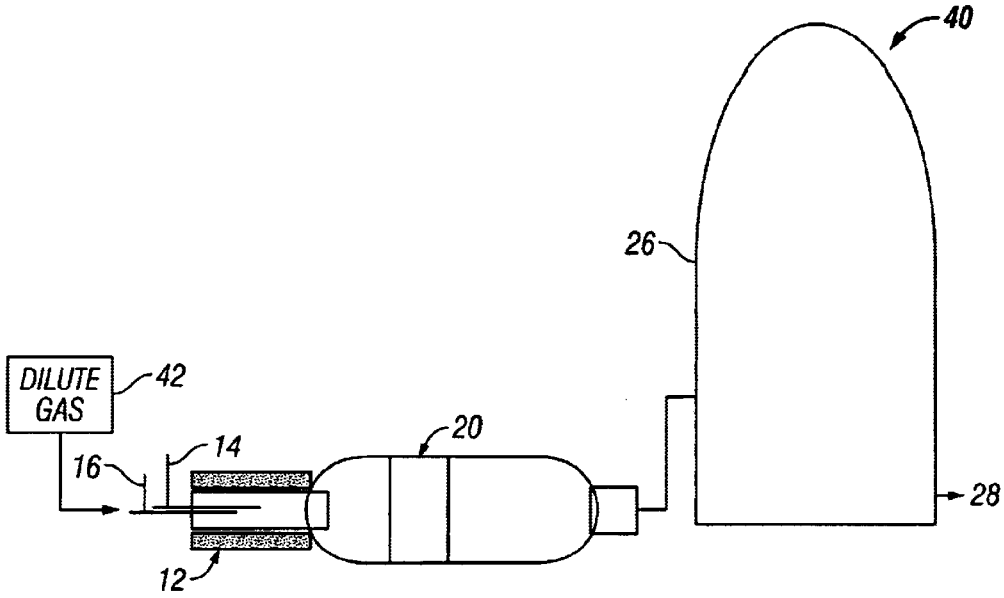
FIG. 3 (Prior Art)
FIG. 3 is a simplified schematic view of another prior diffusion furnace apparatus.
Figure 4:
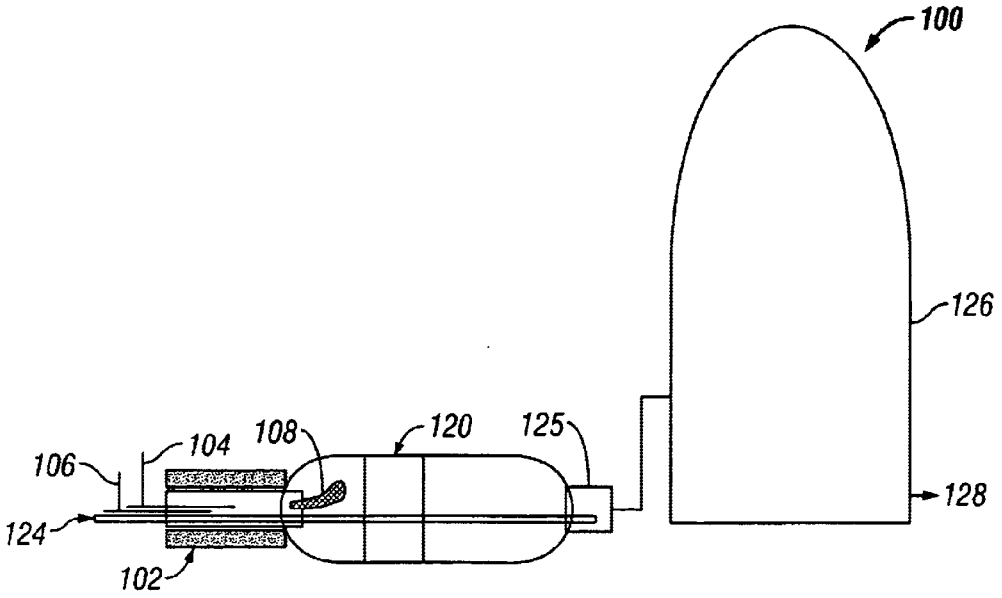
FIG. 4 is a simplified schematic view of a diffusion furnace apparatus according to an embodiment of the present invention.

FIG. 4 shows a diffusion furnace apparatus 100 which includes a torch or combustion heater 102 for heating $H_2$ from line 104 and $O_2$ from line 106. The torch heater 102 heats the $H_2$ and $O_2$ to a safe combustible temperature producing a flame 108, and an oxidizing gas in the form of water vapor or steam is generated from the $H_2$ and $O_2$ in an external torch chamber 120 disposed downstream of the heater 102. The heater 102 and chamber 120 are components of the torch device or combustion device. A dilution gas is added to the steam via a dilution gas line 124 which extends through the torch heater 102 and torch chamber 120 to a mixing region 125. Examples of the dilution gas include Ar, $N_2$, and the like. The dilution gas line 124 allows the dilution gas to be heated by the heat generated in the torch device without mixing the dilution gas and the oxidizing gas until they reach a location downstream of the flame. In this way, the dilution gas does not cause disturbance at the ignition point of the flame to make it unstable.

In the embodiment shown, the mixing of the dilution gas and the oxidizing gas takes place in a mixing region 125 downstream of the torch chamber 120, prior to entry into the furnace tube 126 for thermal oxidation to form the oxide film on one or more semiconductor wafers inside the furnace tube 126. An exhaust 128 is provided for the process gas to exit the furnace tube 126. The dilution gas desirably is sufficiently preheated to avoid condensation when mixed with the steam generated in the torch chamber 120. Because the dilution gas is heated by the heat in the torch chamber 120, no additional heater is needed.

Although FIG. 4 shows a straight dilution gas line 124, it need not be straight and may be configured in any suitable manner. It is desirable that sufficient heat is transferred into the dilution gas in the dilution gas line 124 to heat the dilution gas so that it is close in temperature to the steam in the mixing region 125 to avoid condensation problems. For instance, the temperature of the dilution gas may be within about 300° to about 1000° C., more desirably within about 750° C. to about 900° C., of the temperature of the steam when they reach the mixing region 125. The desired heat transfer can be achieved by any or all of the following: generating sufficient heat in the torch chamber 120, providing a sufficient length of the dilution gas line 124 to permit adequate time for the dilution gas to be heated, and producing a sufficiently low dilution gas flow rate to permit adequate time for the dilution gas to be heated.

In order to form a thin oxide layer with uniform thickness on the substrate in the furnace tube 126, which is desirable for certain gate oxides, it is important to keep the flow rate of the process gas including the oxidizing gas and the dilution gas sufficiently low. This is beneficial because it allows more time for the heat transfer between the torch chamber 120 and the dilution gas in the dilution gas line 124. In some embodiments, the dilution gas flow rate is at most about 20 slm, and is typically about 3 to about 10 slm. The flow rate of the mixture of the dilution gas and the oxidizing gas may be at most about 30 slm, and is typically about 8 to about 18 slm.

The above-described arrangements of apparatus and methods are merely illustrative of applications of the principles of this invention and many other embodiments and modifications may be made without departing from the spirit and scope of the invention as defined in the claims. For instance, different ways of producing heat in the torch chamber may be used. Different gases and flow rates may be employed. The scope of the invention should, therefore, be determined not with reference to the above description, but instead should be determined with reference to the appended claims along with their full scope of equivalents.

What is claimed is:

1. An apparatus for supplying a diluted process gas into a diffusion furnace for forming an oxide layer on a substrate in the diffusion furnace, the apparatus comprising:

a torch device configured to receive one or more inlet gases supplied by one or more inlet gas lines, the torch device including a torch heater configured to generate an oxidizing gas by heating the inlet gases in a torch chamber disposed downstream of the torch heater;

a dilution gas line configured to receive a dilution gas, the dilution gas line extending through the torch chamber to permit heating of the dilution gas by the heat in the torch device without mixing the dilution gas and the oxidizing gas in the torch chamber; and a mixing region downstream of the torch chamber configured to receive and mix the oxidizing gas and the heated dilution gas prior to entry into the diffusion furnace.

2. The apparatus of claim 1 wherein the oxidizing gas comprises steam generated from $O_2$ and $H_2$ in the torch chamber.

3. The apparatus of claim 1 wherein the dilution gas is selected from the group consisting of Ar and $N_2$.

4. The apparatus of claim 1 wherein the torch heater is configured to produce a flame in the torch chamber to generate the oxidizing gas from the inlet gases.

5. The apparatus of claim 1 wherein the dilution gas line is configured to produce a dilution gas flow of at most about 20 slm.

6. The apparatus of claim 1 wherein the oxidizing gas comprises steam.

7. The apparatus of claim 1 wherein the dilution gas line is configured to produce a diluted gas flow of at most about 30 slm.

8. An apparatus for supplying a diluted process gas into a diffusion furnace for forming an oxide layer on a substrate in the diffusion furnace, the apparatus comprising:

an oxidizing gas chamber configured to receive one or more inlet gases supplied by one or more inlet gas lines;

means for heating the one or more inlet gases in the oxidizing gas chamber to generate an oxidizing gas;

a dilution gas line configured to receive a dilution gas, the dilution gas line extending through the oxidizing gas chamber to permit heating of the dilution gas by the heat in the oxidizing gas chamber without mixing the dilution gas and the oxidizing gas in the oxidizing gas chamber; and a mixing region downstream of the oxidizing gas chamber configured to receive and mix the oxidizing gas and the heated dilution gas prior to entry into the diffusion furnace.

9. A method of supplying a diluted process gas into a diffusion furnace for forming an oxide layer on a substrate in the diffusion furnace, the method comprising:

supplying one or more inlet gases into a chamber;

heating the one or more inlet gases in the chamber to generate an oxidizing gas;

flowing a dilution gas through a dilution gas line which extends through the chamber to permit heating of the dilution gas by the heat in the chamber without mixing the dilution gas and the oxidizing gas in the chamber; and mixing the oxidizing gas and the heated dilution gas downstream of the chamber prior to entry into the diffusion furnace.

10. The method of claim 9 wherein the one or more inlet gases comprise $O_2$ and $H_2$, and the oxidizing gas comprises steam.

11. The method of claim 10 wherein heating the one or more inlet gases comprises producing a flame from the $O_2$ and $H_2$ to generate the steam.

12. The method of claim 9 wherein the dilution gas is selected from the group consisting of Ar and $N_2$.

13. The method of claim 9 wherein the dilution gas is flowed at a flow rate of at most about 20 slm.

14. The method of claim 13 wherein the dilution gas flow rate is sufficiently low so that the dilution gas is heated to a temperature which is substantially equal to a temperature of the oxidizing gas before mixing the oxidizing gas and the heated dilution gas.

15. The method of claim 13 wherein the flow rate of the mixed oxidizing gas and heated dilute gas is at most about 30 slm.

16. A method of supplying a diluted process gas into a diffusion furnace for forming an oxide layer on a substrate in the diffusion furnace, the method comprising:

supplying one or more inlet gases into a chamber;

producing a flame in the chamber to heat the one or more inlet gases in the chamber to generate an oxidizing gas;

flowing a dilution gas through a dilution gas line which extends at least partially through the chamber to a location downstream of the flame to permit heating of the dilution gas by the heat in the chamber without mixing the dilution gas and the oxidizing gas at or upstream of the flame; and mixing the oxidizing gas and the heated dilution gas downstream of the flame prior to entry into the diffusion furnace.

17. The method of claim 16 wherein the one or more inlet gases comprise $O_2$ and $H_2$, and the oxidizing gas comprises steam.

18. The method of claim 16 wherein the dilution gas is selected from the group consisting of Ar and $N_2$.

19. The method of claim 16 wherein the dilution gas is flowed at a flow rate of at most about 20 slm.

20. The method of claim 16 wherein the flow rate of the mixed oxidizing gas and heated dilute gas is at most about 30 slm.

* * * * *